US009386645B2

(12) United States Patent
O'Neil et al.

(10) Patent No.: US 9,386,645 B2
(45) Date of Patent: Jul. 5, 2016

(54) LED DRIVE CIRCUITRY WITH DISCONNECT SWITCH

(71) Applicants: Tom O'Neil, Torrance, CA (US); Lee Chiang, Sylmar, CA (US)

(72) Inventors: Tom O'Neil, Torrance, CA (US); Lee Chiang, Sylmar, CA (US)

( * ) Notice: Subject to any disclaimer, the term of this patent is extended or adjusted under 35 U.S.C. 154(b) by 0 days.

(21) Appl. No.: 14/283,565

(22) Filed: May 21, 2014

(65) Prior Publication Data

US 2015/0341993 A1 Nov. 26, 2015

(51) Int. Cl.
*G05F 1/00* (2006.01)
*H05B 33/08* (2006.01)

(52) U.S. Cl.
CPC ..... *H05B 33/083* (2013.01); *H05B 33/08* (2013.01); *H05B 33/0815* (2013.01); *H05B 33/0845* (2013.01)

(58) Field of Classification Search
CPC ..... H05B 33/08
USPC ..... 315/291, 294, 295, 308, 312, 185 R, 315/224, 246, 247
See application file for complete search history.

(56) References Cited

U.S. PATENT DOCUMENTS

2009/0237007 A1* 9/2009 Leng ..... H05B 33/0815 315/297
2009/0295776 A1* 12/2009 Yu ..... H05B 33/0818 345/212
2009/0322252 A1* 12/2009 Shiu et al. ..... 315/297
2012/0262084 A1* 10/2012 Liu ..... H05B 33/0815 315/250
2013/0038233 A1* 2/2013 Chu et al. ..... 315/224
2013/0300305 A1* 11/2013 Wray ..... 315/210

* cited by examiner

*Primary Examiner* — Minh D A
(74) *Attorney, Agent, or Firm* — Clement Cheng

(57) ABSTRACT

A circuit is described which allows an LED driver to be controlled by a control signal in such a manner that at a predetermined dimming level the output current goes to zero instead of continuing to indefinitely low dim levels, thus avoiding the possibility of flickering or shimmer at extremely low dim levels. An electronic circuit for driving an LED load with a conventional LED drive circuit has inputs connected to a power source and output terminals providing regulated output power including a load disconnect switch in series with the LED load which has a control node responsive to a control circuit; and a control input which commands varying levels of input power. The control circuit is configured to be responsive to the control input so that when the control input corresponds to a certain continuous level of dimming, the load disconnect switch is opened.

9 Claims, 3 Drawing Sheets

LED DRIVE CIRCUITRY WITH DISCONNECT SWITCH

This application claims priority as a nonprovisional of U.S. provisional patent application 61/979,142, filed Apr. 14, 2014 entitled LED Drive Circuitry with Disconnect Switch, by same inventors Thomas O'Neil and Lee Chiang now being filed by applicant assignee EPtronics, Inc., a California Corporation.

FIELD OF THE INVENTION

The present invention is in the field of LED driver circuitry.

DESCRIPTION OF RELATED ART

U.S. Pat. No. 8,203,276 by first named inventor Shackle issued Jun. 19, 2012 describes an example of a deep dimming LED driver which can dim to 0.1% using both PWM and analog dimming, entitled Phase Controlled Dimming LED Driver System And Method Thereof, the disclosure of which is incorporated herein by reference. This is an example of the kind of conventional LED driver dimming circuitry in which at extremely low dim levels, noise from the internal power rails can be perceived in the output light as visible shimmer. Such circuits would be improved by the provision of means to cause the output to go totally to zero at a certain chosen dimming level, rather than allow the output to go so low that it starts to flicker and/or shimmer.

Circuits have been described which involve placing a switch in series with the output for the purpose of eliminating "after glow" when the LED drive current is switched off during pulse width modulation. An example of such a circuit is U.S. Pat. No. 8,482,225 entitled Electronic Circuits And Methods For Driving A Diode Load by inventor Szczeszynski issued Jul. 9, 2013, the disclosure of which is incorporated herein by reference. The control of the switch is simply in synchronization with the PWM signal at a high frequency. Although a switch is present which could be used to totally turn off the LED current, this action is not enabled or described in the patent.

SUMMARY OF THE INVENTION

The present application relates to driving and dimming LED light sources using an AC voltage source, and more particularly, to schemes for driving the LED current to zero at a predetermined input dimming level.

When LED light sources are dimmed with conventional dimming control signals such as pulse width modulation (PWM) or 0-10V dimming, there is always a problem with noise when dimming to very low levels. Minor noise levels which are always present on the power rails of conventional LED drivers can accidentally perturb the output signal of a dimming LED driver when it is being dimmed down to very low levels, for example 1% or less. This results in random noisy fluctuations in the LED drive current which the human eye perceives as shimmering in the output light. Another variation may be the presence of 120 Hz fluctuation in the output signal which is known as "flicker". This effect may be seen regardless of the dimming method used. For example, if the DC output current is continuous (analog dimming) then at the lowest dimming levels there may appear unwanted fluctuations in amplitude. If PWM dimming is used, then there may be unwanted fluctuations in the pulse width of the LED current pulses which are perceived by the human eye as shimmer or flicker. PWM dimming may be combined with amplitude modulation as well, and both effects can happen simultaneously.

Sometimes the signal processing circuitry may be set to restrict the minimum output pulse width permitted, and sometimes a lower limit may be set upon the output LED drive current. However, in circumstances such as phase control dimming this is unsatisfactory because at very low dimming levels the input power may be insufficient to even maintain the desired minimum output current. It is therefore apparent that in order to avoid noisy shimmer and flicker at extremely low dim levels, there is a need for circuitry which can cause LED driver output current to go sharply to zero at a chosen minimum dim level of the control signal. According to one aspect of the invention, an input control signal is used to control the output current of an LED driver. A switch is placed in series with the output. Circuitry decodes the control signal and turns the switch off when the input control signal corresponds to a predetermined dimming level, and turns it back on again at another predetermined level. As a result of this when the dimming control is turned down, the output of the driver goes sharply to zero after the control is turned down to the planned minimum dimming level, eliminating any possibility of shimmering or flickering in the light output at the lowest levels.

In other aspects of the invention, the input control signal is either a PWM control signal or a 0-10V analog signal. In yet another aspect of the invention, the output current of the LED driver is a variable DC level (analog dimming) and in still another aspect of the invention the output current of the LED driver has pulse width modulation dimming.

BRIEF DESCRIPTION OF THE DRAWINGS

The foregoing features of the invention, as well as the invention itself may be more fully understood from the following detailed description of the drawings, in which.

The following call out list of elements can be a useful guide in referencing the elements of the drawings.

100 First Transistor
102 First Resistor
104 Second Resistor
106 Second Transistor
107 Third Transistor
108 Third Resistor
109 Fourth Resistor
110 First Capacitor
111 Op-Amp
112 Fifth Resistor
113 Sixth Resistor
114 Seventh Resistor
115 Op-Amp
116 Eighth Resistor
117 Ninth Resistor
118 Optocoupler

119 Zener Diode
120 Mosfet Switch
121 Tenth Resistor
122 Led Drive Array
123 AC Powered Led Driver
124 Zero to Ten Volt Input
126 Control Input
127 Second Capacitor
128 Output
129 Eleventh Resistor
130 Primary Input
132 Node

DETAILED DESCRIPTION

Figure 1:
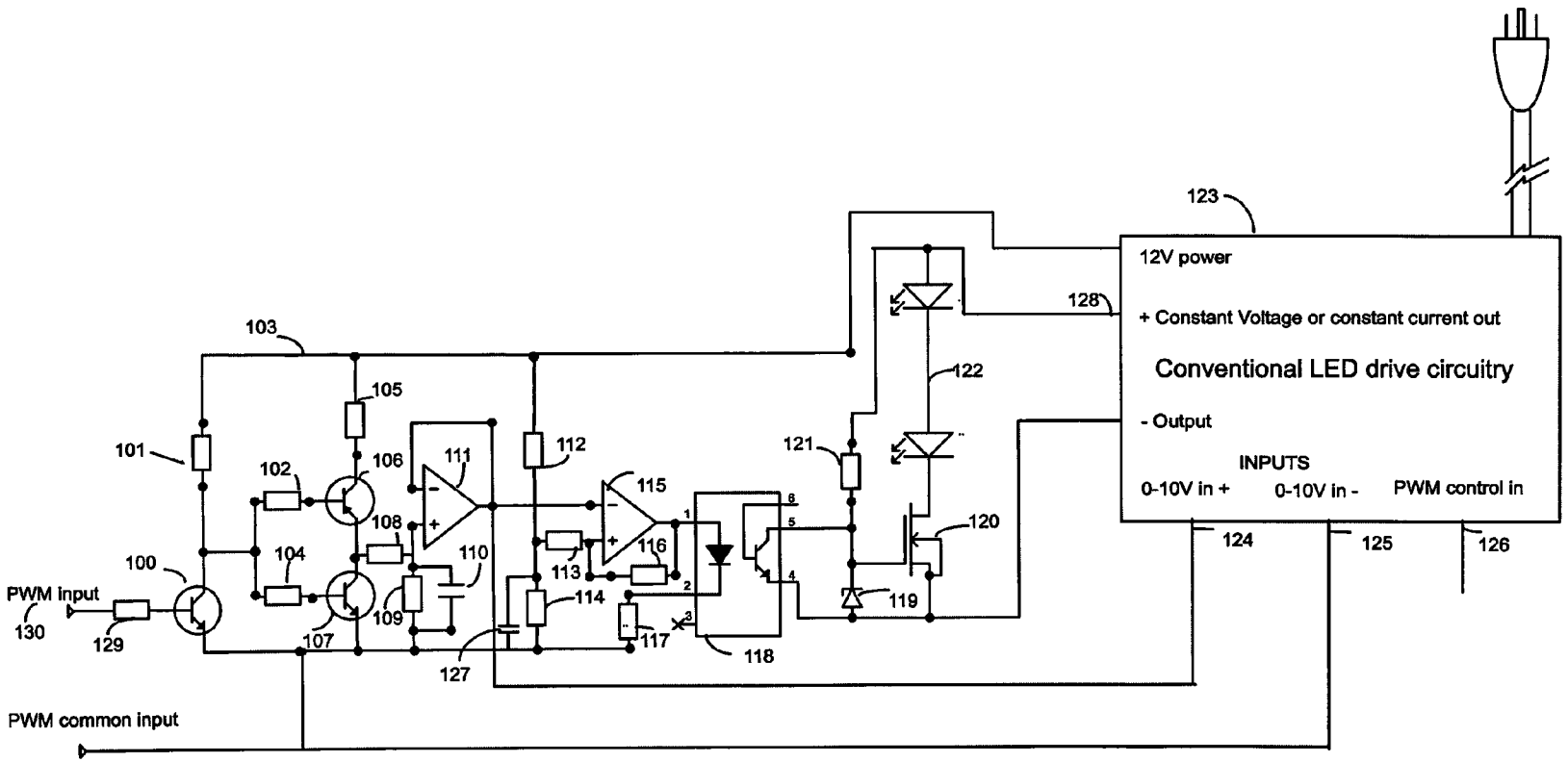
FIG. 1 is a schematic diagram of an electronic circuit for driving an LED load with a load disconnect switch which operates when a PWM control input commands an output level below a predetermined minimum level.

FIG. 1 Shows a preferred embodiment of the invention. The AC powered LED driver circuitry 123 is shown as a box in FIG. 1 and is well known to those skilled in the art. The AC powered LED driver circuitry 123 is connected to the AC power line and at its output 128 there may be either a regulated constant current LED drive or a regulated constant voltage supply, depending on the kind of LED drive array 122 being driven. The dimmed output current might be either DC (analog) or pulse width modulated (digital). At input 124 there can be applied a 0-10V analog control signal, which determines the output power of the driver. The output 128 may be either a regulated constant current or a regulated constant voltage, and may have either analog or PWM (digital) dimming. The conventional LED driver circuitry is driving LED array 122, and in series with array 122 is mosfet switch 120, the gate of which functions as a control node, which when set low allows the possibility of reducing the LED current completely to zero. It thus functions as a load disconnect switch. Switch 120 is operated by the following control circuit means: A PWM control input signal representing the desired output brightness level is applied at the primary input 130. This is typically at a voltage level of 5V, and the current delivered to first transistor 100 is limited by eleventh resistor 129. First transistor 100 is switched either hard on or hard off by the PWM input signal, and delivers an inverted version of the PWM signal, now amplified to a peak to peak level of approximately 12V to the junction of first resistor 102 and second resistor 104. Second transistor 106 and third transistor 107 lower the impedance level of the signal to provide a reliable drive for the following stage. The low impedance output is from the node between the emitter of second transistor 106 and the collector of third transistor 107. Third resistor 108 and fourth resistor 109 are used to adjust the voltage level of the signal to correspond to the desired 0-10V range, and in conjunction with first capacitor 110 the PWM signal is converted into a DC level, the voltage of which is proportional to the pulse width of the PWM signal. This voltage is applied to the high impedance non-inverting input of op-amp 111. Op amp 111 is configured as an impedance buffer so that its output produces a low impedance version of the voltage at its non-inverting input. This output from op amp 111 goes to two places, the 0-10V input 124 of the conventional LED drive circuitry and to the inverting input of op-amp 115.

Op amp 115 is configured as a comparator with hysteresis. Fifth resistor 112 and seventh resistor 114 provide at their midpoint a voltage which is a desired fraction of 10V, the intention of which is to arrange that the output of the conventional LED drive circuitry is turned off below a planned fraction of its nominal output current. Second capacitor 127 is for removing noise which might otherwise affect the trip point of the comparator. Sixth resistor 113 and eighth resistor 116 give op amp 115 the property of hysteresis. Once the voltage at the inverting input goes below the voltage at the midpoint of fifth resistor 112 and seventh resistor 114, the output of op amp 115 is forced high. Sixth resistor 113 and eighth resistor 116 convey a small fraction of this high output voltage back to the non-inverting input so that subsequently the inverting input voltage has to rise to a higher level in order to send the output of op amp 115 low again. Thus the comparator switches at a relatively lower input voltage level for a decreasing input DC level and a relatively higher input voltage level for an increasing input DC level.

Mosfet switch 120 has its gate connected to the positive voltage end of LED string 122 through tenth resistor 121. Zener diode 119 clamps the gate voltage at a level for satisfactory operation of mosfet 120. Optocoupler 118 is turned on when the output of op amp 115 goes high. Ninth resistor 117 determines the drive current applied to the input of the optocoupler. Optocoupler 118 pulls the gate voltage of mosfet 120 low, turning it off. So the net effect of the circuitry is that when the command signal being sent to input 124 goes below the chosen minimum width, the output level of the conventional LED drive circuitry is turned completely off. The command level being sent to input 124 then has to go to a slightly greater level to turn the output back on again, so that the output current does not flicker off and on in response to noise. When the control signal at primary input 130 is set to progressively smaller pulse widths, the output will always go sharply to zero at a predetermined minimum output current, avoiding the possibility of a noisy, shimmering output at excessively low output levels.

Figure 2:
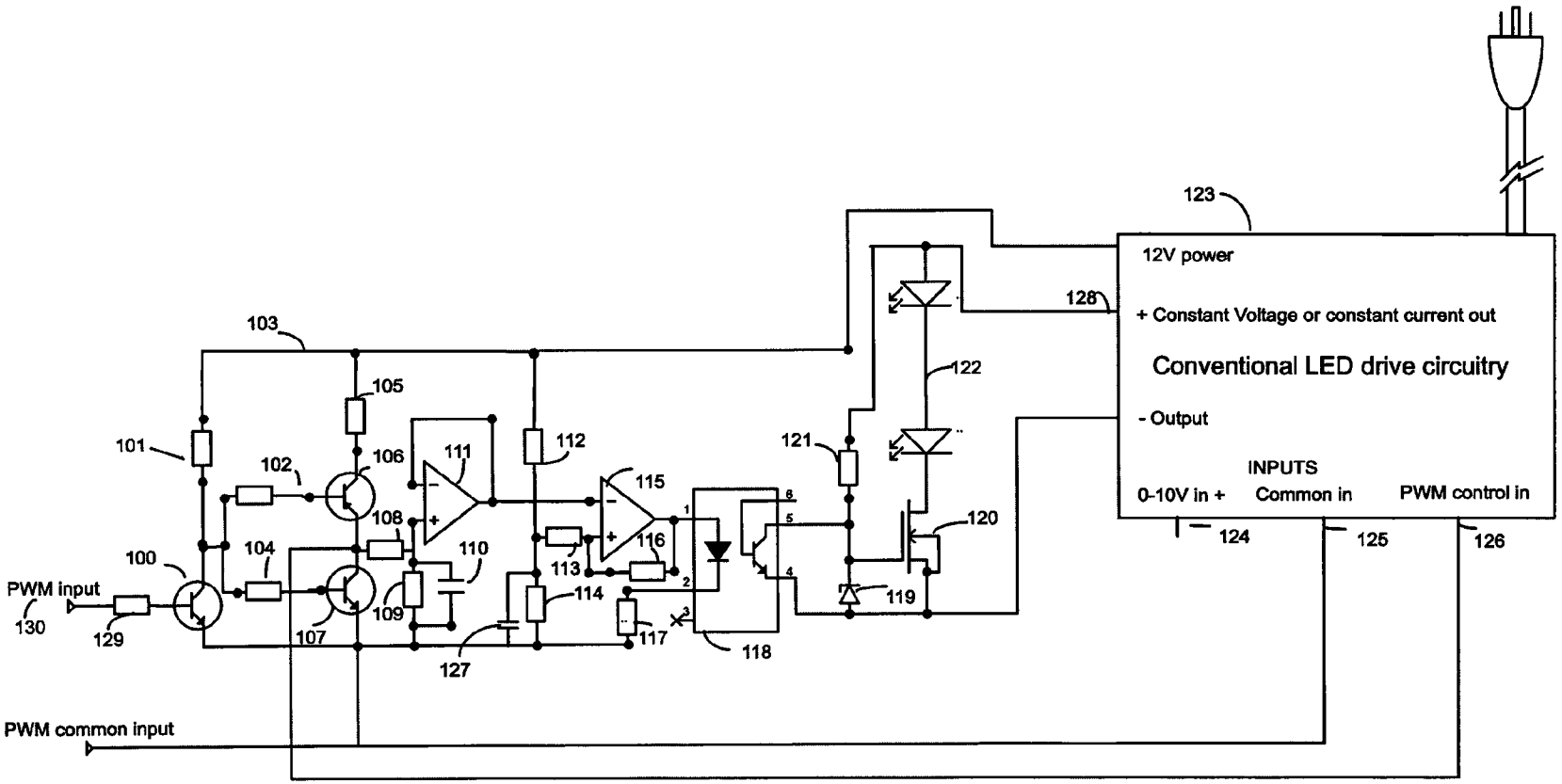
FIG. 2 is a schematic diagram of an electronic circuit for driving an LED load with a load disconnect switch which operates when a PWM control input commands an output level below a predetermined minimum level.

FIG. 2 shows another embodiment of the invention in which the conventional LED drive circuitry is being controlled by the PWM control input signal being provided to its control input 126. This signal is derived from the low impedance node between second transistor 106 and third transistor 107. Once again, when the input control pulse width becomes less than the predetermined amount, the LED driver output is completely cut off, avoiding the possibility of a noisy, shimmering output at excessively low output levels.

Figure 3:
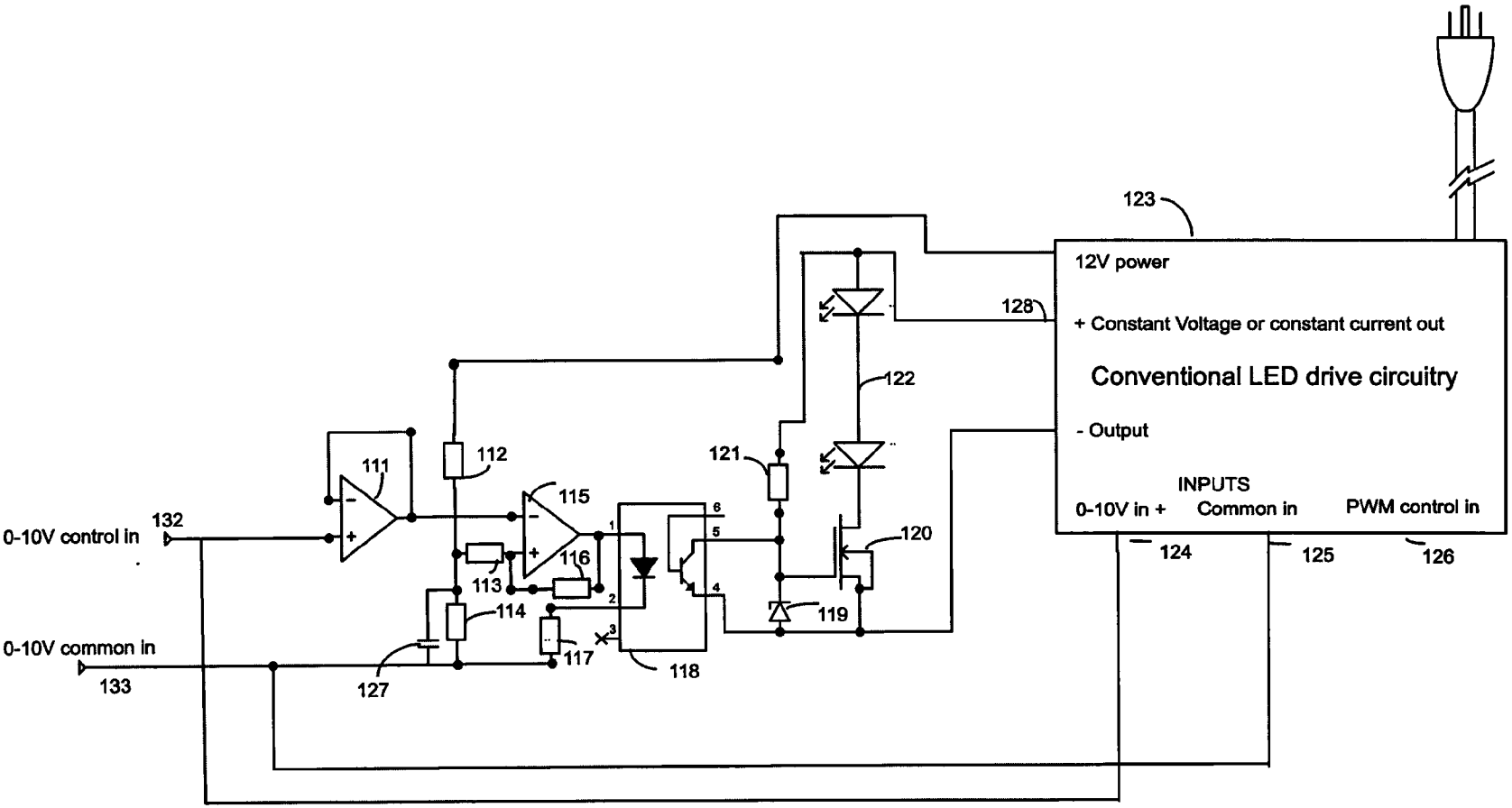
FIG. 3 is a schematic diagram of an electronic circuit for driving an LED load with a load disconnect switch which operates when a 0-10V control input commands an output level below a predetermined level.

FIG. 3 shows yet another embodiment of the invention, in this case with the input being in the form of a 0-10V control input. The input 124 of the conventional LED drive circuitry provides an approximately 1 mA current source. The 0-10V control input at node 132 clamps this current source to a fixed voltage which represents the desired fraction of the output power such that 10V means full power and 0V means off. In this case the op amp 111 buffers the 0-10V control signal and passes it on at a reduced impedance level to the op amp 115, which functions as before. When the 0-10V control input becomes less than the predetermined amount, the LED driver output is completely cut off, avoiding the possibility of a noisy, shimmering output at excessively low output levels.

Having described preferred embodiments that serve to illustrate various concepts, structures and techniques that are the subject of this patent, it will now become apparent to those of ordinary skill in the art that other embodiments incorporating these concepts, structures and techniques may be used. For example, the load disconnect switch which is described as a mosfet could equally well be a bipolar transistor, an IGBT or any of the many types of solid state switches which are well known to those of skill in the art. An electromechanical switch could also be used. Although one string of LEDs with one switch is described, many strings of LEDs could be used with multiple switches. Although PWM control and 0-10V controls are described in exemplary embodiments, clearly any of the numerous analog and digital protocols known to those skilled in the art could be used with equal effect. The control format could equally be any of the multiple kinds of phase control dimming methods which are known to those skilled in the art. The use of op-amps is described to construct buffers and comparator functions, but clearly the same results could be produced using discrete transistor circuits. Although analog signal processing is described, it is clear that corresponding digital circuits could be contrived having the same functionality. The output of the conventional LED driver circuitry could be either constant voltage or constant current, and these can be both amplitude modulated or pulse width modulated. Although the example embodiments show circuitry running off the AC mains, the invention could equally be used for circuitry running off a DC power supply. Accordingly, it is submitted that that the scope of the patent should not be limited to the described embodiments but rather should be limited only by the spirit and scope of the following claims.

What is claimed is:

1. An electronic circuit for driving an LED load comprising:

a. a conventional dimming LED drive circuit having power inputs connected to a power source, at least one control input responsive to at least one control signal and output terminals from which regulated output power is provided; and b. a load disconnect switch not enabled for pulse width modulation, separate from the conventional dimming LED drive circuit and in series with the LED load which has a control circuit responsive to said at least one control signal;

wherein said control circuit is configured to be responsive to said control signal so that when the control input commands an output below a certain continuous level of dimming, the load disconnect switch is opened for the purpose of preventing the appearance of shimmer in the light output as the dimming level approaches zero, wherein the control input is converted to a DC level and a comparator operates the load disconnect switch when the DC level is diminished below a certain amplitude, wherein the comparator operates the load disconnect switch through an optocoupler.

2. The electronic circuit of claim 1, wherein the control input is a PWM signal.

3. The electronic circuit of claim 1, wherein the control input is a 0-10V signal.

4. The electronic circuit of claim 1, wherein the comparator operates at a relatively lower level for a declining control signal and at a relatively higher level for an increasing control signal.

5. The electronic circuit of claim 4, wherein the control input is a PWM signal.

6. The electronic circuit of claim 4, wherein the control input is a 0-10V signal.

7. The electronic circuit of claim 4, wherein the control input is a phase control signal, derived from the power line.

8. A method for operating a dimmable electronic circuit, comprising the steps of:

a. providing a control input;

b. providing a conventional dimming LED driver responsive to said control input;

c. providing the LED load with a disconnect switch responsive to said control input, wherein the disconnect switch is separate from the conventional dimming LED driver and is not enabled for PWM;

d. configuring the control input to command a dimming level which is lower than a predetermined level which is greater than zero; and e. maintaining the disconnect switch in a continuously open mode whenever said dimming level is lower than said predetermined level; comparing the input control signal with a chosen reference; and opening the switch when the input control signal corresponds to an output level below a chosen minimum level.

9. The method of claim 8, wherein the switch is configured to prevent low level shimmering and flickering which might otherwise be observed at excessively low dimming levels.

* * * * *